US008820622B2

(12) United States Patent
Chen et al.

(10) Patent No.: US 8,820,622 B2
(45) Date of Patent: Sep. 2, 2014

(54) CASH BOX PROVIDED WITH SELF-LOCKING MECHANISM

(75) Inventors: Xiaodian Chen, Guangzhou (CN); Yuqing Ye, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 369 days.

(21) Appl. No.: 13/264,017

(22) PCT Filed: Jul. 21, 2010

(86) PCT No.: PCT/CN2010/075347

§ 371 (c)(1), (2), (4) Date: Oct. 12, 2011

(87) PCT Pub. No.: WO2011/009408

PCT Pub. Date: Jan. 27, 2011

(65) Prior Publication Data

US 2012/0037052 A1 Feb. 16, 2012

(30) Foreign Application Priority Data

Jul. 22, 2009 (CN) ..... 2009 1 0164766

(51) Int. Cl.

| | |
|---|---|
| ***G07B 15/00*** | (2011.01) |
| ***E05B 65/46*** | (2006.01) |
| ***G07F 9/06*** | (2006.01) |
| ***E05G 1/04*** | (2006.01) |
| ***E05C 3/04*** | (2006.01) |
| *E05B 65/08* | (2006.01) |
| *A45C 13/10* | (2006.01) |
| *E05B 63/24* | (2006.01) |
| *E05C 19/16* | (2006.01) |
| *A45C 1/00* | (2006.01) |
| *E05C 3/12* | (2006.01) |

(52) U.S. Cl.

CPC ..... *E05G 1/04* (2013.01); *E05B 65/461* (2013.01); *E05B 65/0811* (2013.01); *A45C 13/1076* (2013.01); *E05B 63/244* (2013.01); *G07F 9/06* (2013.01); *E05C 19/16* (2013.01); *A45C 2001/006* (2013.01); *E05C 3/042* (2013.01); *E05C 3/12* (2013.01)

USPC ..... 232/15; 232/16; 70/63; 109/45

(58) Field of Classification Search

USPC ..... 27/1 D, 7, 12, 15, 16, 44; 70/63, 84–88; 109/45–47; 232/1 D, 7, 12, 15, 16, 44

See application file for complete search history.

(56) References Cited

U.S. PATENT DOCUMENTS

| | | | | | |
|---|---|---|---|---|---|
| 1,065,146 | A | | 6/1913 | Kohler | |
| 2,119,592 | A | | 6/1938 | MacDonald | |
| 2,524,907 | A | * | 10/1950 | Harris | 232/15 |
| 2,580,752 | A | * | 1/1952 | Forester | 232/15 |
| 2,604,259 | A | * | 7/1952 | Anderson | 232/15 |
| 3,797,735 | A | * | 3/1974 | Sciortino et al. | 232/16 |
| 3,841,550 | A | | 10/1974 | Kaneda et al. | |
| 4,471,905 | A | * | 9/1984 | Sloma et al. | 232/12 |
| 5,890,439 | A | | 4/1999 | McGunn | |
| 7,004,386 | B2 | | 2/2006 | Chien | |

FOREIGN PATENT DOCUMENTS

| | | | | |
|---|---|---|---|---|
| CN | 2123591 | U | | 12/1992 |
| CN | 2468103 | Y | | 12/2001 |
| CN | 2515394 | Y | | 10/2002 |
| CN | 101012711 | A | | 8/2007 |
| CN | 201122304 | Y | | 9/2008 |
| CN | 201142089 | Y | | 10/2008 |
| CN | 201152080 | Y | * | 11/2008 |
| CN | 101649709 | A | | 2/2010 |
| GB | 2 449 748 | A | | 5/2008 |

OTHER PUBLICATIONS

International Search Report dated Nov. 4, 2010 from corresponding International Application No. PCT/CN2010/075347.

European Search Report dated Nov. 27, 2012 from corresponding European Application No. 10801967.0.

* cited by examiner

*Primary Examiner* — William Miller

(74) *Attorney, Agent, or Firm* — Wolf, Greenfield & Sacks, P.C.

(57) ABSTRACT

A cash box (1) used for storing cashes and provided with a self-locking mechanism comprises a box body (11), a box door (12) and a box door self-locking mechanism. The cash-box (1) is arranged on a cashbox bracket (3). The box door self-locking mechanism comprises a lock (21) for locking the box door (12) and a door switch structure (22) which is fixed on the cashbox bracket (3) and used for opening or closing the box door (12). The lock (21) comprises a movable lock tongue (211) connected with the box door (12) and a lock cylinder (212) which is fixed on one wall of the box body (11) and movably buckled with the movable lock tongue (211). A triggering element which acts on the door switch structure is arranged on the box door (12) which is opened by the door switch structure when the box body (11) is pushed into the cashbox bracket (3) and which is locked by the door switch structure when the box body (11) is drawn out of the cashbox bracket (3). The cashbox has self-locking function while being forcedly dismantled and ensures the safety of articles inside the box while being displaced and transported.

7 Claims, 7 Drawing Sheets

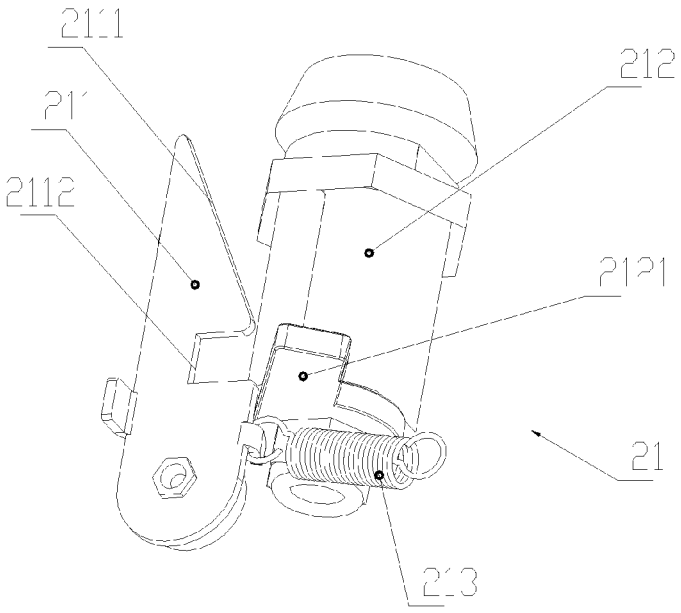
Fig. 7
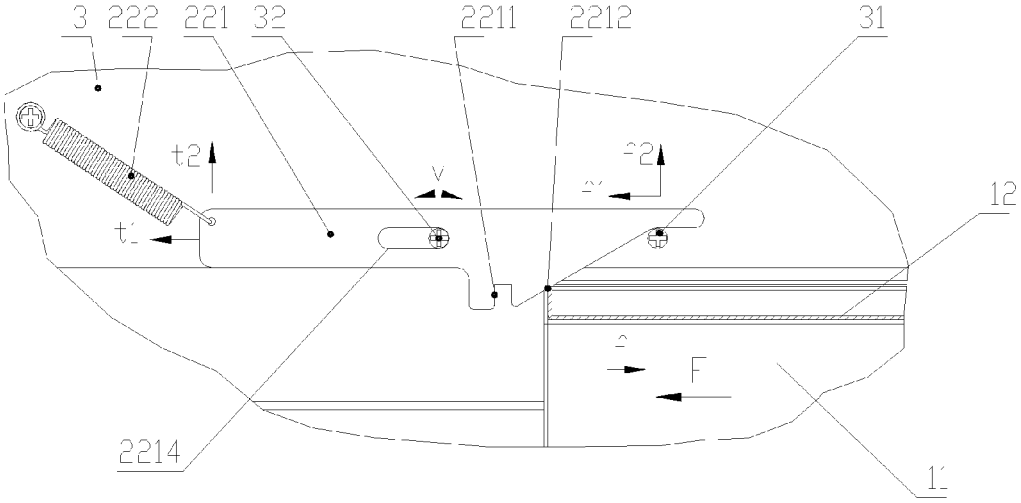

Fig. 8
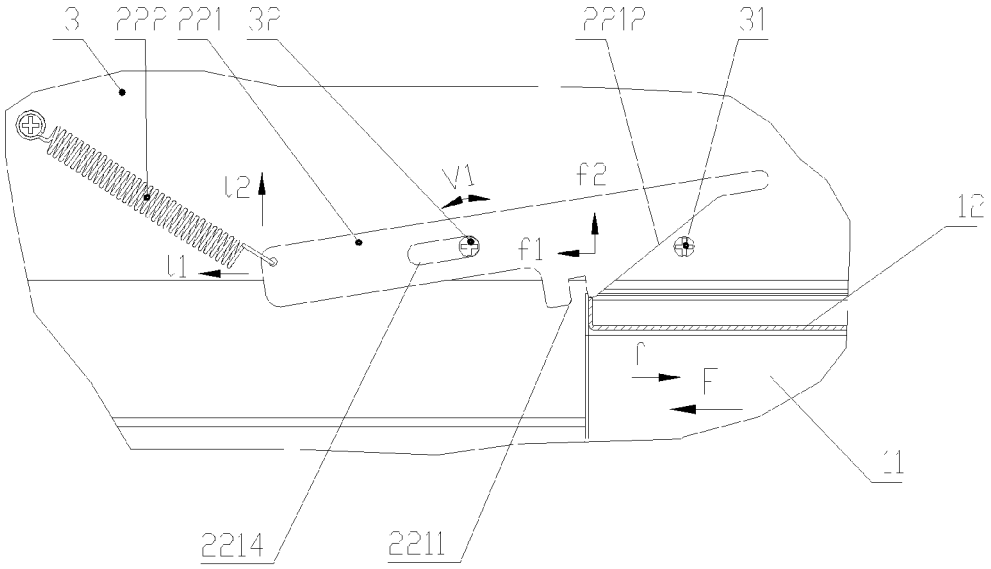
Fig. 9
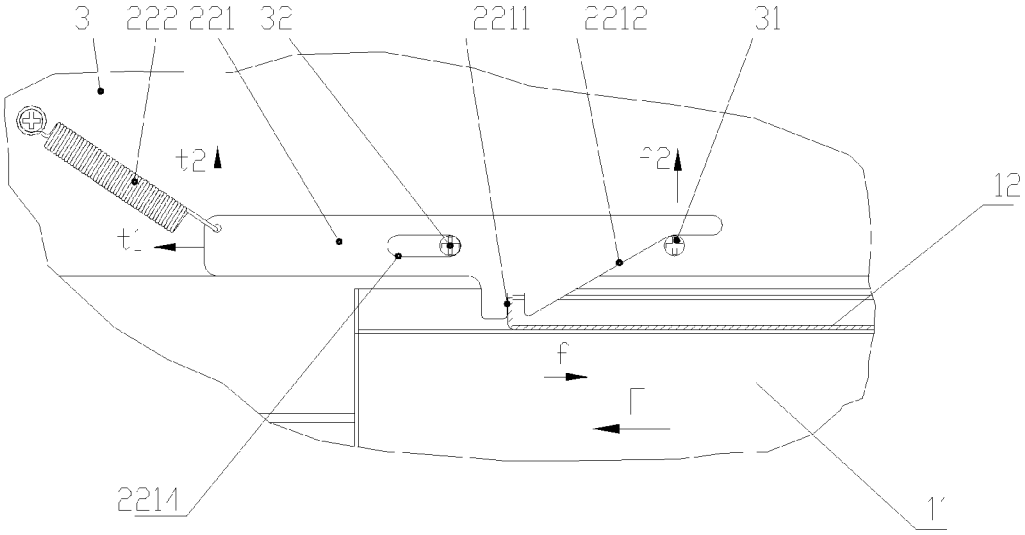
Fig. 10

CASH BOX PROVIDED WITH SELF-LOCKING MECHANISM

The present application is the national phase of International Application No. PCT/CN2010/075347, titled "CASH BOX PROVIDED WITH SELF-LOCKING MECHANISM", filed on Jul. 21, 2010, which claims the benefit of priority to Chinese patent application No. 200910164766.2 titled "CASH BOX PROVIDED WITH SELF-LOCKING MECHANISM", filed with the Chinese State Intellectual Property Office on Jul. 22, 2009. The entire disclosure thereof is incorporated herein by reference.

FIELD OF THE INVENTION

The present invention relates to a storage cabinet, more particular, to a storage cabinet for storing cash which has a self-locking mechanism.

BACKGROUND OF THE INVENTION

As the self-help financial instrument is widely used, the circulation amount of cash is increased in the self-help financial instrument, especially in the self-help cash deposit service equipment. In circulation of cash, how to ensure the safety of these instruments and cash becomes a problem to be considered and resolved by all of the service providers. How to allow the cash in the self-help equipment to be circulated safer and more convenient is always a problem being studied.

The cashbox is required to be in an open state when the self-help equipment is in a normal service, so as to ensure that the cash to be deposited is normally received therein. When the cashbox which is full of money is required to be maintained or replaced, it becomes an urgent problem to be solved to maintain the cashbox being in self-locked state without manual operation so that the operator is absolutely isolated from the cash in the cashbox, thereby ensuring the safety of the cash.

SUMMARY OF THE INVENTION

The object of the present invention is to provide a cashbox having a self-locking mechanism, in particular, a cashbox which may automatically lock the door of the cashbox by cooperating with a door switch structure when taking out the cashbox.

The present invention provides a cashbox having a self-locking mechanism, being installed to a cashbox bracket in a cash service equipment, comprises a box body, a box door and a box door self-locking mechanism. The box door self-locking mechanism comprises a locking device for locking the box door and a door switch structure for opening or closing the box door. The locking device comprises a movable locking tongue fixed in an inner side of the box door and a lock cylinder fixed on an inner side wall of the box body and being buckled with the movable locking tongue. The box door is provided with a triggering member cooperated with the door switch structure. The door switch structure opens the box door when the box body is pushed into the cashbox bracket, and locks the box door when the box body is drawn out from the cashbox bracket, by being engaged with the triggering member.

Further, the locking device further comprises an elastic element, one end of the elastic element is fixed on an inner side wall of the box door, and the other end of the elastic element hooks the movable locking tongue to impart a driving force to the movable locking tongue such that the movable locking tongue is buckled with the lock cylinder.

Preferably, the elastic element is a spring.

Preferably, the movable locking tongue comprises a guiding inclined surface, a recess disposed in the guiding inclined surface and a pivot disposed at one end of the movable locking tongue about which the movable locking tongue is rotatable in a certain angle range. The lock cylinder comprises a projecting piece corresponding to the recess, the projecting piece is configured to engaged in the recess when the box door is closed and disengaged from the recess with rotation of the lock cylinder when the lock cylinder is rotated by a key.

Further, the door switch structure comprises a movable plate installed to the cashbox bracket. The movable plate comprises a second recess configured to selectively engage with the triggering member. When the box body is pushed into the cashbox bracket and the triggering member contacts with the second recess, the second recess is engaged with the triggering member so as to prevent the box door from being continuously pushed into along with the box body. When the box body is drawn out from the cashbox bracket until the box body is integrated with the box door and the box door is automatically locked, the triggering member is disengaged from the second recess such that the box door is drawn out from the cashbox bracket along with the box body.

Further, the movable plate comprises a guiding groove, the cashbox bracket is provided with a guiding column, and the movable plate is hung on the guiding column through the guiding groove. The movable plate is rotatable around the guiding column in a certain angle range, and is movable forwardly and backwardly along a lengthwise direction of the guiding groove within a range defined by the engagement between the guiding column and the guiding groove.

Still further, the door switch structure further comprises a second elastic element and a guiding element. One end of the second elastic element is fixed to the cashbox bracket, and the other end of the second elastic element hooks a first end of the movable plate, so as to impart an oblique and upward tension force to the movable plate to drive the movable plate to rotate in a clockwise direction. The guiding element is fixed to the cashbox bracket and contacts with a second end of the movable plate to limit the movable plate rotating in the clockwise direction.

Preferably, the second end of the movable plate is provided with a guiding inclined surface cooperated with the guiding element, the engagement between the guiding inclined surface and the guiding element allows the triggering member engaged in the second recess to be disengaged from the second recess.

Preferably, the second elastic element is a spring.

Preferably, the door switch structure comprises a magnetic element fixed to the cashbox bracket at a predetermined position. When the cashbox is pushed into the cashbox bracket and the cashbox passes through the magnetic element, the triggering member is attracted by the magnetic element so as to fix the box door and prevent the box door from being pushed into the box body bracket along with the box body, such that the box door is opened. When the cashbox is drawn out from the cashbox bracket and the box body passes through the magnetic element, the box body and the box door are integrated together, such that the box door is closed and self-locked.

The embodiments of the present invention have the following advantages.

Since the cashbox includes the self-locking mechanism, the operator cannot directly access the cash in the cashbox unless he or she has a proper unlocking tool, which further ensures the safety of cash. Besides, the cashbox may be separately taken out from a cash service equipment as an closed storage container having a locking function for replacement and transportation. The problem that the operator for operating and maintaining the automatic deposit machine and the ticket vendor may violate relating rules and regulations to access the cash may be solved. The present invention may be widely used for collecting and transporting cash and notes in financial institution.

BRIEF DESCRIPTION OF THE DRAWINGS

FIG. 7 is a perspective structural view of the locking device in the self-locking mechanism, particularly showing that the locking device is in an unlock state, i.e., the projecting piece is disengaged from the recess of the movable locking tongue with rotation of the lock cylinder;

FIG. 8 is a schematic view of a door switch structure in an initial state, showing a state that a triggering member of the box door initially contacts with a guiding inclined surface of a movable plate of the door switch structure when the cashbox is pushed into the cashbox bracket;

FIG. 9 is a schematic view showing a state when a triggering folded edge of the cashbox door slides to a edge of the recess of the movable plate along the guiding inclined surface of the movable plate of the door switch structure;

FIG. 10 is a schematic view showing a state that the recess of the door switch structure is engaged with the triggering folded edge of the cashbox door so as to fix and open the box door while the box body continuously slides to open the box door;

DETAILED DESCRIPTION

Hereinafter, the technical solutions in the embodiments of the present invention will be described clearly and completely with reference to the accompanying drawings in the present invention. Obviously, the described embodiments are only a part of embodiments of the present invention, rather than all of embodiments. Based on the embodiments in the present invention, all of other embodiments achieved by the skilled in the art without making inventive efforts fall into the protection scope of the present invention.

Figure 1:
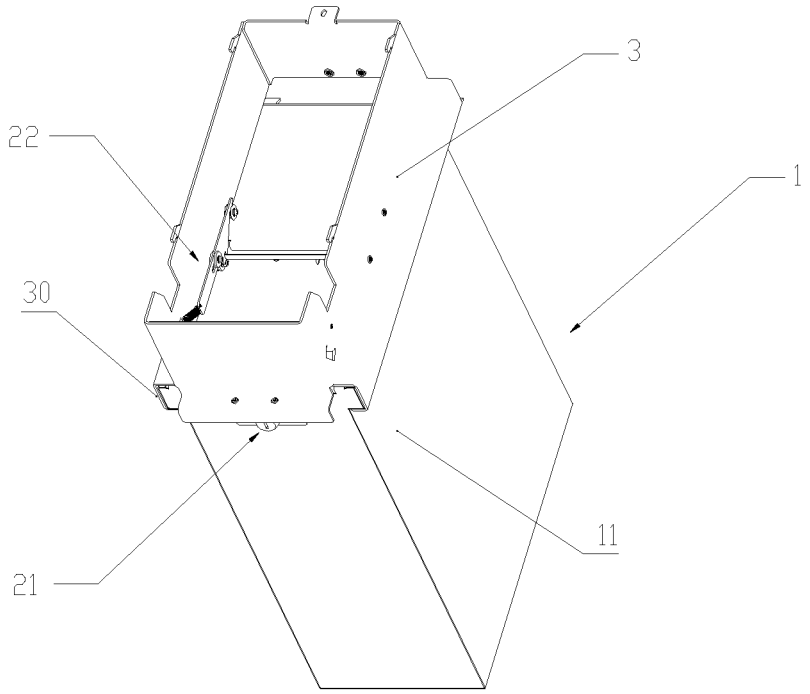
FIG. 1 is a perspective view of a cashbox having a self-locking mechanism when being installed to a cashbox bracket.
Figure 2:
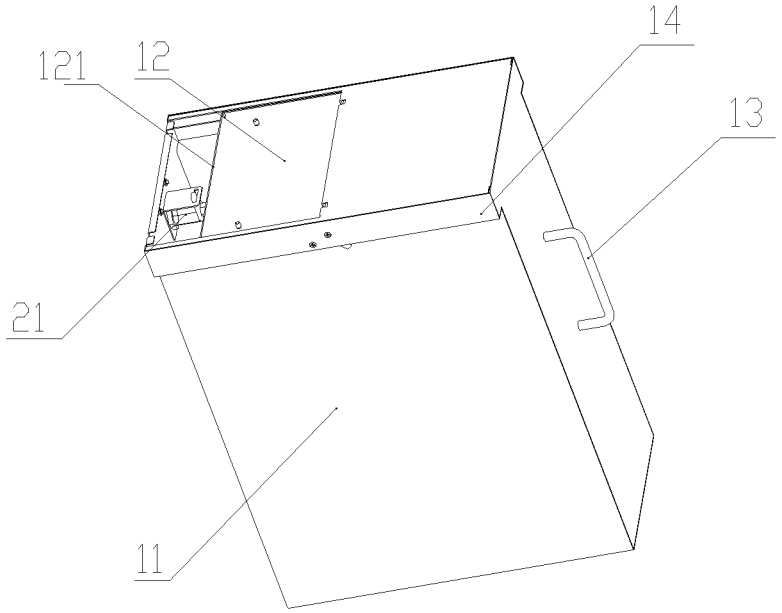
FIG. 2 is a perspective view of the cashbox having the self-locking mechanism.

Referring to FIGS. 1 and 2, a cashbox 1 having a self-locking mechanism according to the present invention includes a box body 11, a box door 12 and a box door self-locking mechanism. The cashbox 1 is mounted to a cashbox bracket 3. The box door self-locking mechanism includes a locking device 21 for locking the box door 12 and a door switch structure 22 disposed on the cashbox bracket 3 and acting on the box door 12. The door switch structure 22 may open and maintain the box door 12 into an operating state when the box body 11 is pushed into the cashbox bracket 3, and may close the box door 12 when the box body 11 is drawn out from the cashbox bracket 3. When the box door 12 is closed, the locking device 21 may automatically lock the box door 12. Besides, in order to be easily operated, the cashbox 1 is provided with a handle 13. Thus, the cashbox 1 may be pushed into or drawn out from the bracket 3 by holding the handle 13, so as to be easily operated. Besides, in order to assemble or disassemble the cashbox 1 from the cashbox bracket 3, the cashbox 1 is provided with rails 14, and the cashbox bracket 3 is provided with guide grooves 30 engaged with the rails 14. Alternatively, the cashbox 1 may be provided with guide grooves, and the cashbox bracket 3 may be provided with rails, as long as the cashbox 1 may be easily pushed into and drawn out from the cashbox bracket 3.

The specific structures of the locking device 21 and the door switch structure 22 for the box door will be described in detail below.

Referring to FIGS. 3 to 7, the locking device 21 includes a movable locking tongue 211 disposed in the inner side of the box door 12, and a lock cylinder 212 fixed on an inner wall of the box body 11 and buckled with the movable locking tongue 211. The movable locking tongue 211 has a guiding inclined surface 2111, a recess 2112 disposed in the guiding inclined surface 2111, and a pivot 2113 located at one end of the movable locking tongue 211. The movable locking tongue 211 may be rotated about the pivot 2113. The movable locking tongue 211 is connected with a spring 213 near the pivot 2113. One end of the spring 213 is fixed to the inner wall of the box door 12, and the other end thereof hooks the movable locking tongue 211. The spring 213 imparts a downward tension force to the movable locking tongue 211 (FIG. 5) so as to drive the movable locking tongue 211 to rotate in a clockwise direction (FIG. 7), thus maintaining the relative position between the locking tongue 211 and the lock cylinder 212. In addition, the lock cylinder 212 has a projecting piece 2121 corresponding to the recess 2112. The projecting piece 2121 is engaged into the recess 2112 when the box door 12 is closed, so as to lock the box door 12. When the lock cylinder 212 is rotated by a key, the projecting piece 2121 may be disengaged with the recess 2112 along with the rotation of the lock cylinder 212.

Figure 3:
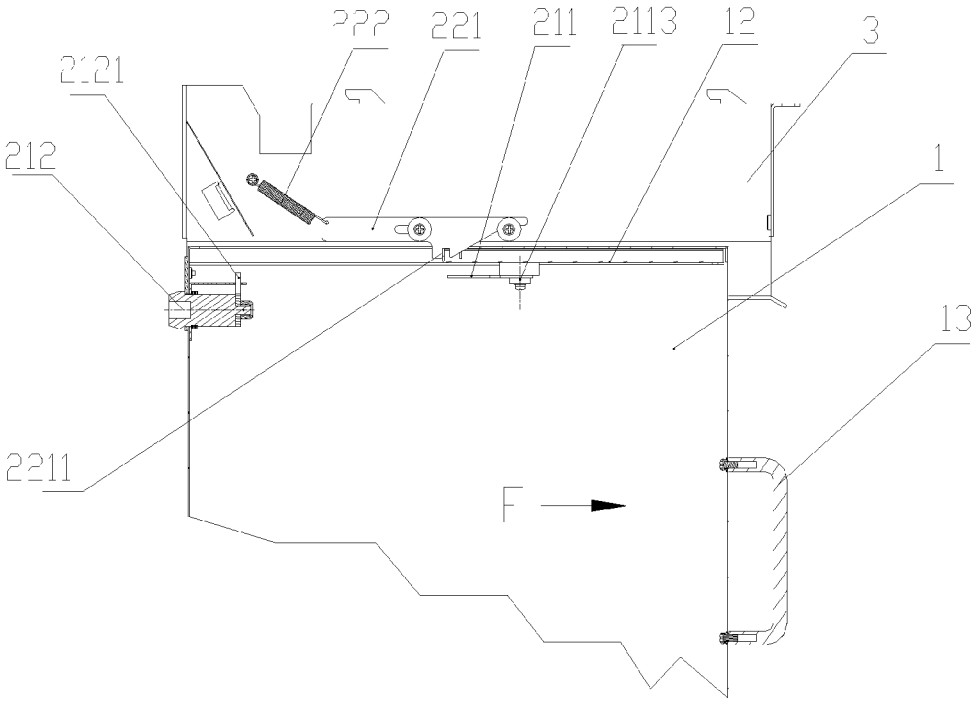
FIG. 3 is a schematic structural sectional view of the cashbox having the self-locking mechanism when being installed to the cashbox bracket.
Figure 4:
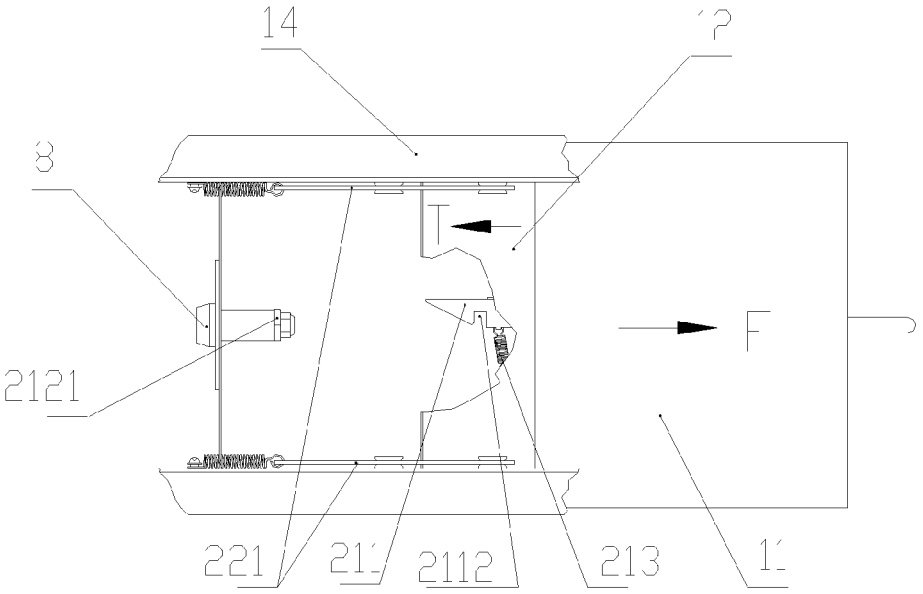
FIG. 4 is a schematic structural top view of the cashbox having the self-locking mechanism in a state that a box door is opened, in which a portion of the cashbox bracket is shown and the box door is partially cut out.
Figure 12:
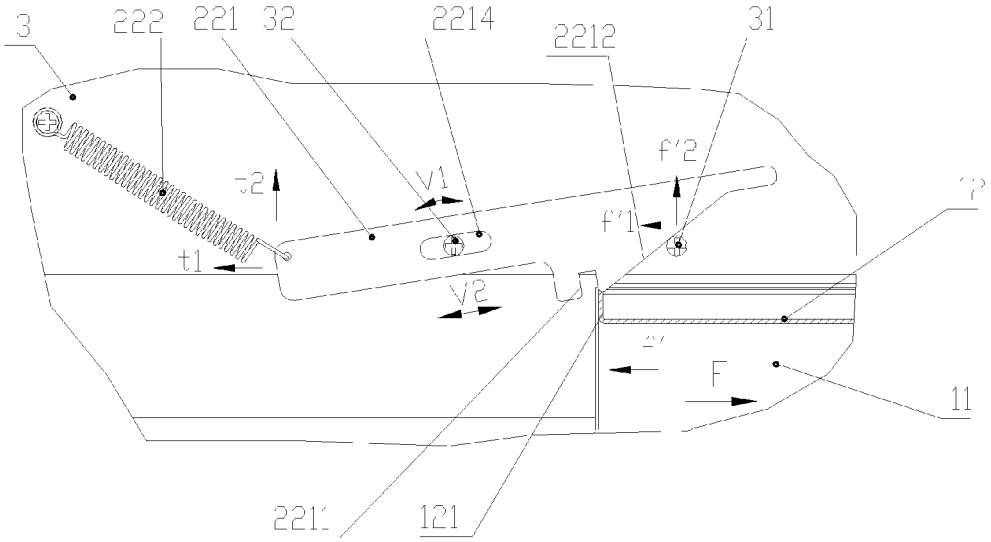
FIG. 12 is a schematic view showing a state that the triggering folded edge of the box door is disengaged from the recess of the door switch structure and is drawn out from the cashbox bracket along with the box body after the box door is closed and locked, particularly showing the principle that the triggering folded edge is disengaged with the recess.

Referring to FIGS. 3 and 12, the door switch structure 22 includes a movable plate 221 installed to the bracket 3 and a diagonal tensile spring 222. One end of the diagonal tensile spring 222 is fixed to the cashbox bracket 3, and the other end thereof hooks the one end of the movable plate 221 so as to impart an oblique and upward tension force to the movable plate. The movable plate 221 has a guiding groove 2214, and the cashbox bracket 3 is provided with a guiding column 32. The movable plate 221 is hung on the guiding column 32 through the guiding groove 2214, and the movable plate 221 may rotates about the guiding column 32 within a certain angle range, and may also move leftward and rightward in a length range defined by the engagement between the guiding column 32 and the guiding groove 2214 in V2 direction shown in FIG. 12, i.e., move forward and backward in a lengthwise direction of the guiding groove 2214. Specifically, when the movable plate 221 is in an initial state, the guiding column 32 may act as a fulcrum and one end of the movable plate 221 is hooked by the diagonal tensile spring 222, such that the movable plate 221 subjects to an oblique and upward tension force T which may be decomposed into a horizontal left force t1 and a vertical upward force t2 as shown in FIG. 8. The horizontal left force t1 tends to force the movable plate 221 to move left, and thus, one end of the guiding groove 2214 of the movable plate 221 which is far away from the spring 222 contacts with the guiding column 32, and the guiding column 32 imparts a horizontal right resistance force to the movable plate 221 through the guiding groove 2214 so as to balance the tension force t1, so that the movable plate 221 is maintained in a force balance state and thus is stationary. The vertical upward force t2 tends to force the movable plate to rotate in the clockwise direction. However, the end of the movable plate 221 which is away from the spring 222 has a guiding inclined surface 2212 having a flat portion at the end thereof. The transition corner between the guiding inclined surface 2212 and the flat portion contacts with a guiding wheel 31 disposed on the cashbox bracket 3, which stops the clockwise rotation of the movable plate 221 so as to keep the movable plate 221 stationary. The guiding inclined surface 2212 is further provided with a recess 2211. The recess 2211 may engage with a triggering folded edge 121 disposed on the box door 12. When the movable plate 221 engages with the triggering folded edge 121 of the box door 12, the box door 12 is opened or closed.

Hereinafter, it will further describe the closing or opening operation of the box door 12 performed by the door switch structure 22 of the cashbox self-locking mechanism with reference to figures.

As shown in FIG. 8, when the empty cashbox 1 is pushed into the cashbox bracket 3 while the locking device 21 is in an unlock state, the box door 12, together with the box body 11, is pushed into the cashbox bracket 3 due to a static friction force between the box door 12 and the box body 11, as the box body 11 is pushed into the cashbox bracket 3. The triggering folded edge 121 firstly abuts against the guiding inclined surface 2212 of the movable plate 221. As the box body 11 is continuously pushed into the cashbox bracket 3 under a force F (FIG. 8), the movable plate 221 is imparted a force f with the same direction as the force F by the triggering folded edge 121. The force f acts on the guiding inclined surface 2212, and is decomposed into a horizontal left force f1 and a vertical upward force f2 as shown in FIG. 8 by the guiding inclined surface 2212. Since the force F pushing the cashbox 1 into the cashbox bracket 3 applied by an operator is large enough, the vertical upward force f2 is also large enough and thus may overcome the tension force t2 of the diagonal tensile spring 222, so that the movable plate 221 is rotated about the guiding column 32 in the counterclockwise direction. Thus, one end of the guiding inclined surface 2212 is lifted up by a certain distance and does not contact with the guiding wheel 31. At the same time, the end of the movable plate 221 hooked by the spring 222 is moved downwardly, so that the spring 222 is further stretched, and thus the tension force T is increased. As the cashbox 1 is continuously pushed into the cashbox bracket 3, that is, the box body 11 is continuously moved leftward in the horizontal direction as shown in FIG. 8, and the triggering folded edge 121 on the box door 12 abuts against the guiding inclined surface 2212 and continuously moves leftward in the horizontal direction relative to the guiding inclined surface 2212. In this state, the vertical upward force f2 imparted to the movable plate 221 continuously forces the movable plate 221 to rotate in the counterclockwise direction. In this way, the end of the guiding inclined surface 2212 is lifted to a higher level, while the end of the movable plate 221 hooked by the spring 222 is moved downwardly by a larger distance. Thus, the spring 222 is stretched longer, and the tension force t2 which may limit the counterclockwise rotation of the movable plate 221, i.e. may force the movable plate 221 to move in the clockwise direction, is larger.

As shown in FIG. 9, the triggering folded edge 121 of the box door 12 continuously moves leftward in the horizontal direction relative to the guiding inclined surface 2212 until it contacts with an edge of the recess 2211 in the guiding inclined surface 2212. In this state, if the box door 12, together with the box body 11, is continuously pushed as the box body 11 is continuously pushed, the triggering folded edge 121 will move across the edge of the recess 2211. At the moment when the triggering folded edge 121 moves across the edge of the recess 2211, since the object abutting against the triggering folded edge 121 suddenly disappears, the force f will suddenly disappear, and the component forces f1 and f2 will suddenly disappear. At this moment, the spring 222 acts on the movable plate 221, and the force t2 drives the movable plate 221 to rotate in the clockwise direction. In this regard, the end of the guiding inclined surface 2212 of the movable plate 221 is moved downwardly, and the recess 2211 just engages with the triggering folded edge 121 of the box door 12. Then, the guiding inclined surface 2212 returns to a state in which the guiding inclined surface 2212 contacts with the guiding wheel 31, and does not rotate in the clockwise direction any more since it is stopped by the guiding wheel 31.

As shown in FIG. 10, after the recess 2211 engages with the triggering folded edge 121 of the box door 12, the recess 2211 imparts a horizontal right force f to the box door 12, so as to prevent the box door 12 from continuously moving in the horizontal left direction with the box body 11. This force f is larger than the static friction force between the box door 12 and the box body 11. Therefore, during the period that the box body 11 is continuously pushed into the cashbox bracket 3, the box door 12 does not move any more, while the box body 11 is continuously moved leftward into the cashbox bracket 3, such that the box body 11 is open, i.e., the box door 12 is opened. After the box body 11 completely enters into the cashbox bracket 3, the box door 12 is stopped at a predetermined position by being engaged with the recess 2211, thereby keeping the box body 11 in the open state, which may meet the requirement of depositing money at any moment for user.

Figure 13:
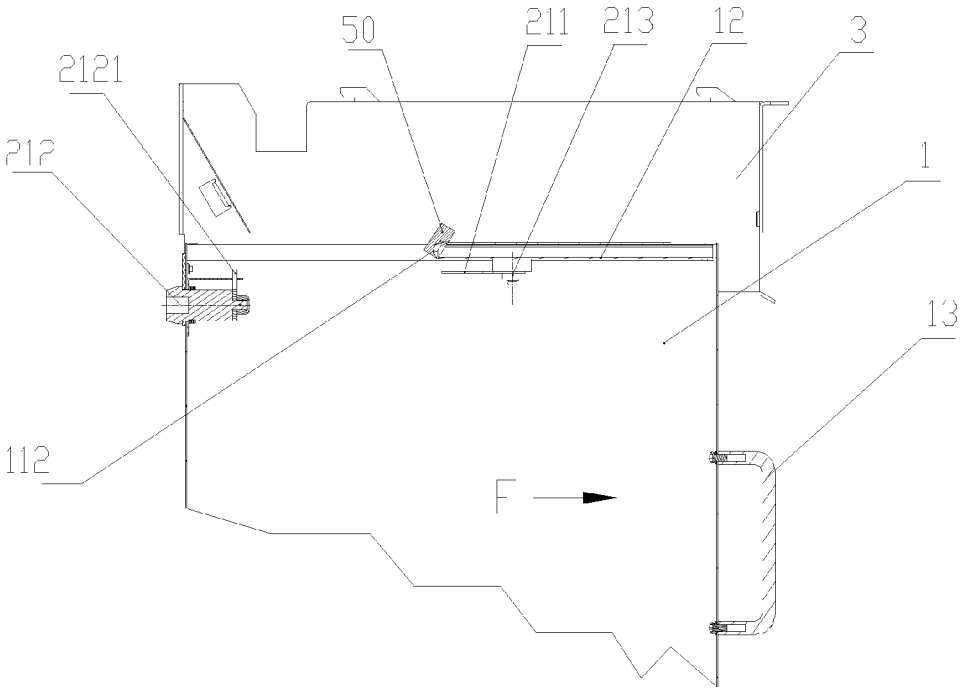
FIG. 13 is a schematic sectional structural view of the cashbox having a self-locking mechanism according to another embodiment of the present invention when being installed to the cashbox bracket, particularly showing that the door switch structure thereof mainly includes a magnetic element.

When the cashbox 1 is full of money, the cashbox 1 which is full of money is drawn out from the cashbox bracket 3 and replaced by an empty cashbox. As shown in FIG. 12, the operator imparts a horizontal right tension force F as shown in the figure to the cashbox 1, and the box body 11 slides in the horizontal right direction and is drawn out from the cashbox bracket 3. In the process of the right slide of the box body 11, the recess 2211 engages with the triggering folded edge 121 of the box door 12, so that the box door 12 cannot slide with the box body 11 in the right direction. Therefore, when the box body 11 slides until the edge of box body 11 integrates with the box door 12, the box door 12 closes the box body 11. When the box door 12 completely closes the box body 11, the locking device 21 is self-locked. At this moment, the box body 11 is continuously drawn rightward out from the cashbox bracket 3, and the box door 12 moves with the box body 11 in right direction since it is tightly locked with the box body 11. Since the triggering folded edge 121 of the box door is engaged in the recess 2211, the box door 12 imparts a horizontal right force f to the movable plate 221 through the recess 2211. The movable plate 221 moves in the right direction under the force f. As shown in FIG. 13, the right end of the guiding groove 2214 of the movable plate 221 does not contact with the guiding column 32 any more, and the guiding column 32 is located in the centre of the guiding groove 2214. Besides, since the guiding wheel 31 is fixed to the cashbox bracket 3 and contacts with the guiding inclined surface 2212, when the movable plate 221 moves in the right direction, the guiding wheel 31 imparts a resistance force f' to the movable plate 221. The resistance force f' acts on the guiding inclined surface 2212, and is decomposed into a horizontal left force f'1 and a vertical upward force f'2 by the guiding inclined surface 2212. Since the tension force F for drawing the cashbox 1 by the operator is large enough, the vertical upward force f'2 is larger than the tension force t2 acting on the movable plate 221 by the spring 222, so that the movable plate 221 is rotated in the counterclockwise direction. The guiding inclined surface 2212 is lifted up, so that the triggering folded edge 121 of the box door 12 is disengaged from the recess 2211. At this time, the cashbox 1 is continuously drawn out by the operator, and the triggering folded edge 121 of the box door 12 does not contact with the movable plate 221. The movable plate is returned to the initial state under the oblique tension force of the spring 222, as shown in FIG. 3.

Thereinafter, the operation of the self-lock of the locking device 21 when the box door 12 is closed will be described in detail.

Figure 5:
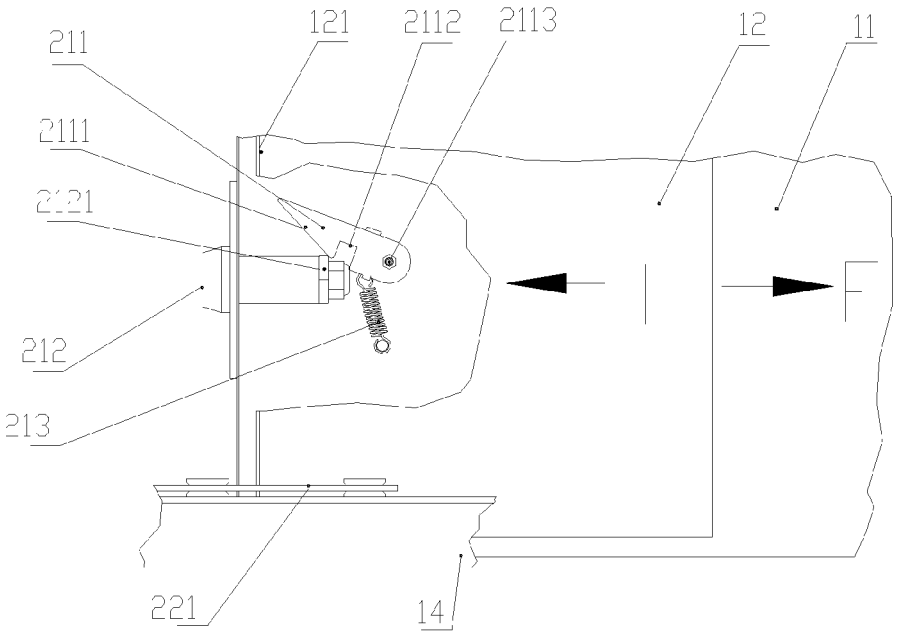
FIG. 5 is a schematic view of an operation of the locking device in the self-locking mechanism immediately before the box door is fully closed, particularly showing a state that a movable locking tongue is lifted up by a projecting piece of a lock cylinder along a guiding inclined surface and the movable locking tongue is about to rotate in a clockwise direction under a spring tension force so as to allow a recess to engage with the projecting piece.
Figure 6:
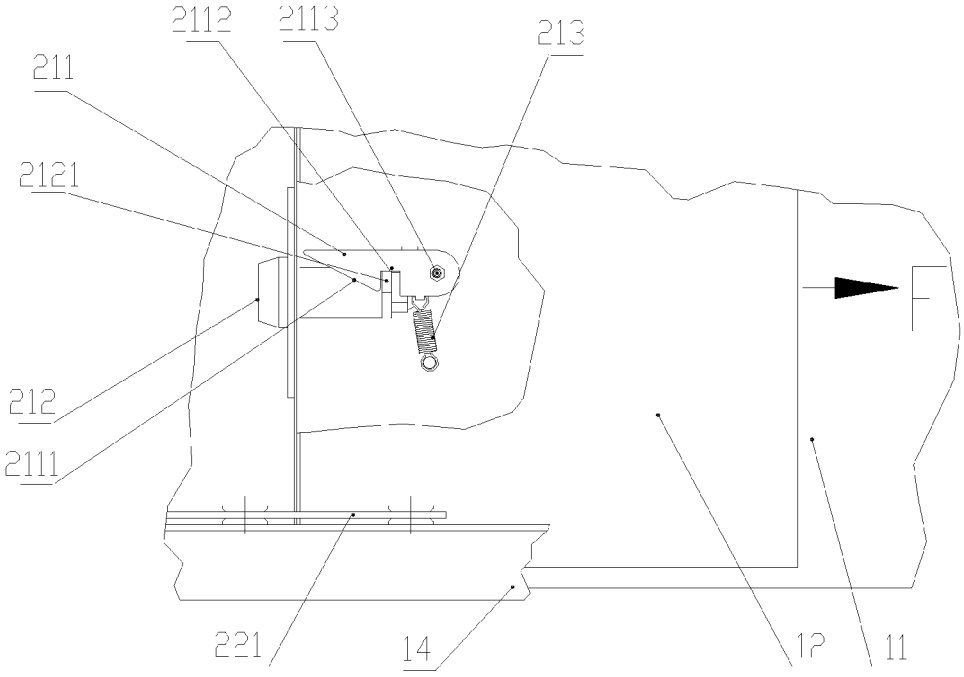
FIG. 6 is a schematic view of the locking device in the self-locking mechanism in a locked state, i.e., the recess of the movable locking tongue being engaged with the projecting piece of the lock cylinder.
Figure 11:
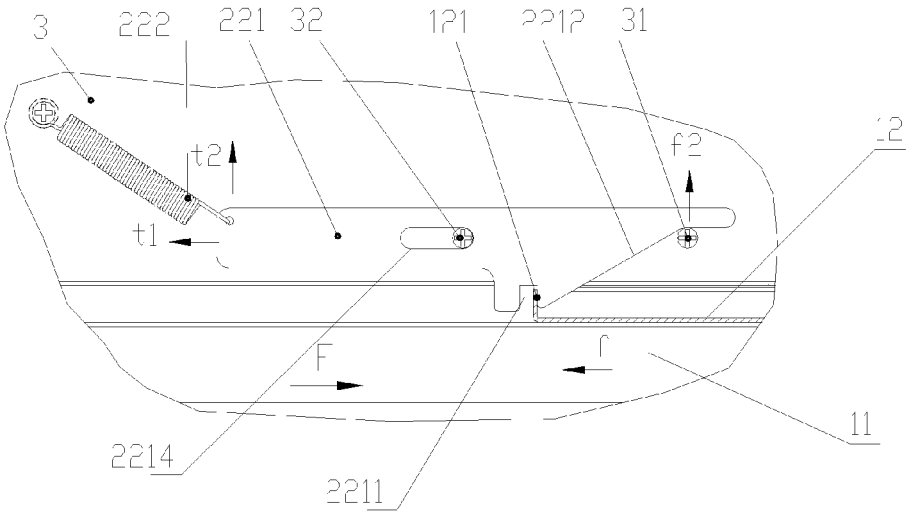
FIG. 11 is a schematic view showing a state that the recess of the door switch structure is continuously engaged with the triggering folded edge of the box door so as to fix the box door while the box body is drawn out and then is integrated with the box door to be closed, when the cashbox is drawn from the cashbox bracket.

Referring to FIGS. 5 to 7, when the cashbox 1 is drawn out from the cashbox bracket 3 by the operator and the box door 12 is closed, the guiding inclined surface 2111 of the locking tongue 211 in the inner side of the box door 12 contacts with the projecting piece 2121 of the lock cylinder 212. Under the guidance of the guiding inclined surface 2111, the locking tongue 211 is rotated about the pivot in the clockwise direction. Thus, the spring 213 is further stretched and imparts a larger downward tension force to the locking tongue 211. During the period that the box door 12 is continuously drawn to close, the projecting piece 2121 always contacts with the guiding inclined surface 2111 of the locking tongue 211 until the projecting piece 2121 reaches the edge of the recess 2112 in the guiding inclined surface 2111 of the locking tongue 211. When the box door 12 and the locking tongue 211 continue moving toward the closing direction, the projecting piece 2121 moves across the edge of the recess 2112. At this time, the locking tongue 211 is rotated in the counterclockwise direction under the tension force of the spring 2113, and the recess 2112 engages with the projecting piece 2121, so as to automatically lock the box door 12. After the cashbox 1 is drawn out, the locking device 21 cannot be unlocked to open the box door 12, unless the operator rotates the lock cylinder 212 with the key to disengage the projecting piece 2121 from the recess 2112.

Besides, the present invention also provides another door switch structure with simple configuration. As shown in FIG. 13, the door switch structure mainly includes a magnetic element 50. The magnetic element 50 is fixed to the cashbox bracket at a predetermined position. When the cashbox 1 is pushed into the cashbox bracket 3 and passes through the magnetic element 50, a triggering member 122 is attracted by the magnetic element 50, so as to fix the box door 12 and prevent the box door 12 from being continuously pushed together with the box body 11 into the box body bracket 3, so that the box door 12 is opened. When the cashbox 1 is drawn out from the cashbox bracket 3, and the box body 11 is drawn out and passes through the magnetic element 50, the box body 11 and the box door 12 are integrated together, so that the box door 12 is closed and locked automatically. After the box door 12 is locked, the tension force may overcome the attractive force of the magnetic element 50 such that the cashbox 1 may be wholly drawn out from the cashbox bracket 3.

The above door switch structures and locking device/mechanisms are merely preferred embodiments. The door switch structure and the operation mode of the box door may be varied depending on various installation modes, and may be installed in variable modes according to the space structures of components. For example, the triggering member of the box door may be of a protruding cylindrical shape, and the door switch structure is correspondingly installed to the cashbox bracket in horizontal direction.

In view of this, for the skilled in the art, many improvements and modifications may be made without departing from the principle of this invention. These improvements and modifications should be deemed to fall into the protection scope of this invention.

What is claimed is:

1. A cashbox having a self-locking mechanism, being installed to a cashbox bracket in a cash service equipment and comprising a box body, a box door and a box door self-locking mechanism, wherein the box door self-locking mechanism comprises a locking device for locking the box door and a door switch structure for opening or closing the box door, wherein the locking device comprises a movable locking tongue fixed in an inner side of the box door and a lock cylinder fixed on an inner side wall of the box body and being buckled with the movable locking tongue, wherein the box door is provided with a triggering member cooperated with the door switch structure, and wherein the door switch structure opens the box door when the box body is pushed into the cashbox bracket, and closes the box door when the box body is drawn out from the cashbox bracket, by being engaged with the triggering member, wherein the door switch structure comprises a movable plate installed to the cashbox bracket, wherein the movable plate comprises a recess configured to selectively engage with the triggering member, when the box body is pushed into the cashbox bracket and the triggering member contacts with the recess, the recess is engaged with the triggering member so as to prevent the box door from being continuously pushed into along with the box body, and when the box body is drawn out from the cashbox bracket until the box body is integrated with the box door and the box door is automatically locked, the triggering member is disengaged from the recess such that the box door is drawn out from the cashbox bracket along with the box body, wherein the movable plate comprises a guiding groove, the cashbox bracket is provided with a guiding column, and the movable plate is hung on the guiding column through the guiding groove, and wherein the movable plate is rotatable around the guiding column in a certain angle range, and is movable forwardly and backwardly along a lengthwise direction of the guiding groove within a range defined by the engagement between the guiding column and the guiding groove.

2. A cashbox having a self-locking mechanism according to claim 1, wherein the locking device further comprises an elastic element, one end of the elastic element is fixed on an inner side wall of the box door, and the other end of the elastic element hooks the movable locking tongue to impart a driving force to the movable locking tongue such that the movable locking tongue is buckled with the lock cylinder.

3. A cashbox having a self-locking mechanism according to claim 2, wherein the elastic element is a spring.

4. A cashbox having a self-locking mechanism according to claim 2, wherein the movable locking tongue comprises a guiding inclined surface, a recess disposed in the guiding inclined surface and a pivot disposed at one end of the movable locking tongue about which the movable locking tongue is rotatable in a certain angle range; and wherein the lock cylinder comprises a projecting piece corresponding to the recess in the guiding inclined surface, the projecting piece is configured to engaged in the recess in the guiding inclined surface when the box door is closed and disengaged from the recess in the guiding inclined surface with rotation of the lock cylinder when the lock cylinder is rotated by a key.

5. A cashbox having a self-locking mechanism according to claim 1, wherein the door switch structure further comprises an elastic element and a guiding element, wherein one end of the elastic element is fixed to the cashbox bracket, and the other end of the second elastic element hooks a first end of the movable plate, so as to impart an oblique and upward tension force to the movable plate to drive the movable plate to rotate in a clockwise direction; and wherein the guiding element is fixed to the cashbox bracket and contacts with a second end of the movable plate to limit the movable plate rotating in the clockwise direction.

6. A cashbox having a self-locking mechanism according to claim 5, wherein the second end of the movable plate is provided with a guiding inclined surface cooperated with the guiding element, the engagement between the guiding inclined surface and the guiding element allows the triggering member engaged in the recess to be disengaged from the recess.

7. A cashbox having a self-locking mechanism according to claim 5, wherein the elastic element is a spring.

* * * * *